United States Patent [19]

Hill

[11] 4,013,256

[45] Mar. 22, 1977

[54] COIL HANDLING PALLET

[75] Inventor: William J. Hill, Holden, Mass.

[73] Assignee: Morgan Construction Company, Worcester, Mass.

[22] Filed: Apr. 24, 1975

[21] Appl. No.: 571,372

[52] U.S. Cl. ..... 248/346; 108/55.3; 211/49 R; 242/85; 248/119 R

[51] Int. Cl.[2] ..... B65D 19/44

[58] Field of Search ..... 248/128, 346, 119 R; 108/51–58; 214/10.5 R, 330, 370, 372, DIG. 4, 130 C; 206/303, 386, 581; 211/13, 23, 24, 49 R; 105/356, 367, 463, 504; 242/78, 79, 85

[56] References Cited

UNITED STATES PATENTS

| | | | |
|---|---|---|---|
| 451,722 | 5/1891 | Evans | 211/49 R |
| 2,366,065 | 12/1944 | Sieurin | 211/49 R X |
| 3,233,753 | 2/1966 | Rich | 214/10.5 R |
| 3,677,199 | 7/1972 | Lindquist | 108/55 |
| 3,677,200 | 7/1972 | Coccagna et al. | 108/53 X |
| 3,873,115 | 3/1975 | Shiflet | 108/55 X |

FOREIGN PATENTS OR APPLICATIONS

| | | | |
|---|---|---|---|
| 1,494,813 | 8/1967 | France | 211/49 R |
| 1,036,584 | 7/1966 | United Kingdom | 248/346 |

*Primary Examiner*—Roy D. Frazier
*Assistant Examiner*—William E. Lyddane
*Attorney, Agent, or Firm*—Thompson, Birch, Gauthier & Samuels

[57] ABSTRACT

A pallet is disclosed for use in a rolling mill for supporting cylindrical product coils during the transfer thereof from one location to another. The pallet includes a generally U-shaped base section having laterally spaced leg members joined at their rearward ends by a bridging member. The upper surfaces of the leg members are inclined slightly from front to rear. Support members or posts extend vertically from the rearward portions of the leg members. A coil supported on the pallet will have its lowermost end resting on the base section with the inclined upper surfaces of the leg members causing the coil to assume a slightly inclined position resting against the support members.

8 Claims, 3 Drawing Figures

COIL HANDLING PALLET

BACKGROUND OF THE INVENTION

This invention relates generally to rolling mills, and more particularly to an improved means for supporting large cylindrical product coils during the transfer thereof from one location to another.

In the past, it has been the practice in rolling mills to transfer product coils by means of hook carrier systems. Such systems include large generally C-shaped hooks which are suspended from an overhead power-free conveyor. The hooks have horizontal support arms which extend axially through the "eyes" of the coils. Experience has shown that as a result of their being transported on hook carriers, the coils undergo damaging distortions commonly referred to as "horse-collaring" and "fanning-out."

"Horse-collaring" is the term given to the condition which occurs when a coil hangs from the horizontal arm of a hook and the weight of the hanging coil rings compresses and reduces the wall thickness of the portion of the coil wall contacted by the support arm, thus adding to the wall thickness at the bottom of the coil. The top wall of the coil becomes dense and the bottom becomes loose, which creates a very poor condition for subsequent coil compaction.

"Fanning-out" is the term given to describe the condition at the ends of a coil as it is carried on a horizontal support arm extending through the coil eye. The weight of the coil is supported by the horizontal arm which creates friction between the surface of the arm and the rings in contact therewith. This friction in turn restrains the upper portion of the coil from spreading out or extending. The forearm of the hook also tends to prevent the coil from expanding in one direction. However, the bottom portion of the coil is loose and free to expand. When the lower portion wall thickness is increased due to horse-collaring, the unrestrained lower portion expands end-wise forcing the rings outward at the lower extremities of the coil. This condition causes the coil to assume a "banana" shape. When the two extremities of a coil are not parallel, and the walls of the coil are not of uniform cross-section, density difficulties are encountered when compacting, and the banded coil often assumes a non-cylindrical shape.

The primary object of the present invention is to avoid the above-mentioned problems by providing a different and improved apparatus for supporting product coils during the transfer thereof from one location to another.

SUMMARY OF THE INVENTION

According to the present invention, a pallet is provided for supporting the coils during transit. The pallet includes a generally U-shaped base section having laterally spaced leg members joined at their rearward ends by a bridging member. The upper surfaces of the leg members are inclined slightly from front to rear. A pair of support members or posts extend vertically from the rearward portions of the leg members. The support members are perpendicular to the inclined upper surfaces of the leg members. A coil supported on the pallet will have its lowermost end resting on the U-shaped base section with the inclined upper surfaces of the leg members causing the coil to assume a near vertical but slightly inclined position resting against the support members.

The near vertical attitude in which coils are supported and carried in the above-described manner imparts a considerable measure of vertical compaction to the coil which is developed by its own weight. This desirable feature is in contrast to the prevalent horse-collaring and fanning-out of coils being transported on conventional hook carrier systems.

Another advantage gained by transporting coils in a near vertical attitude on the pallets of the present invention lies in the fact that the top of the coil is fully exposed and accessible to operating personnel. This facilitates the task of locating and removing the tail end and enough rings to assure that the remainder of the coil is satisfactory from the metallurgical and shape standpoints. This is to be contrasted to the situation which exists as a result of transporting coils on hook carriers, where the tail end of the product length frequently becomes trapped under other rings, making it difficult for operating personnel to locate and remove the desired number of rings.

BRIEF DESCRIPTION OF THE DRAWINGS

An embodiment of the invention will now be described by way of example only, with reference to the accompanying drawings, wherein.

DESCRIPTION OF PREFERRED EMBODIMENT

Figure 1:
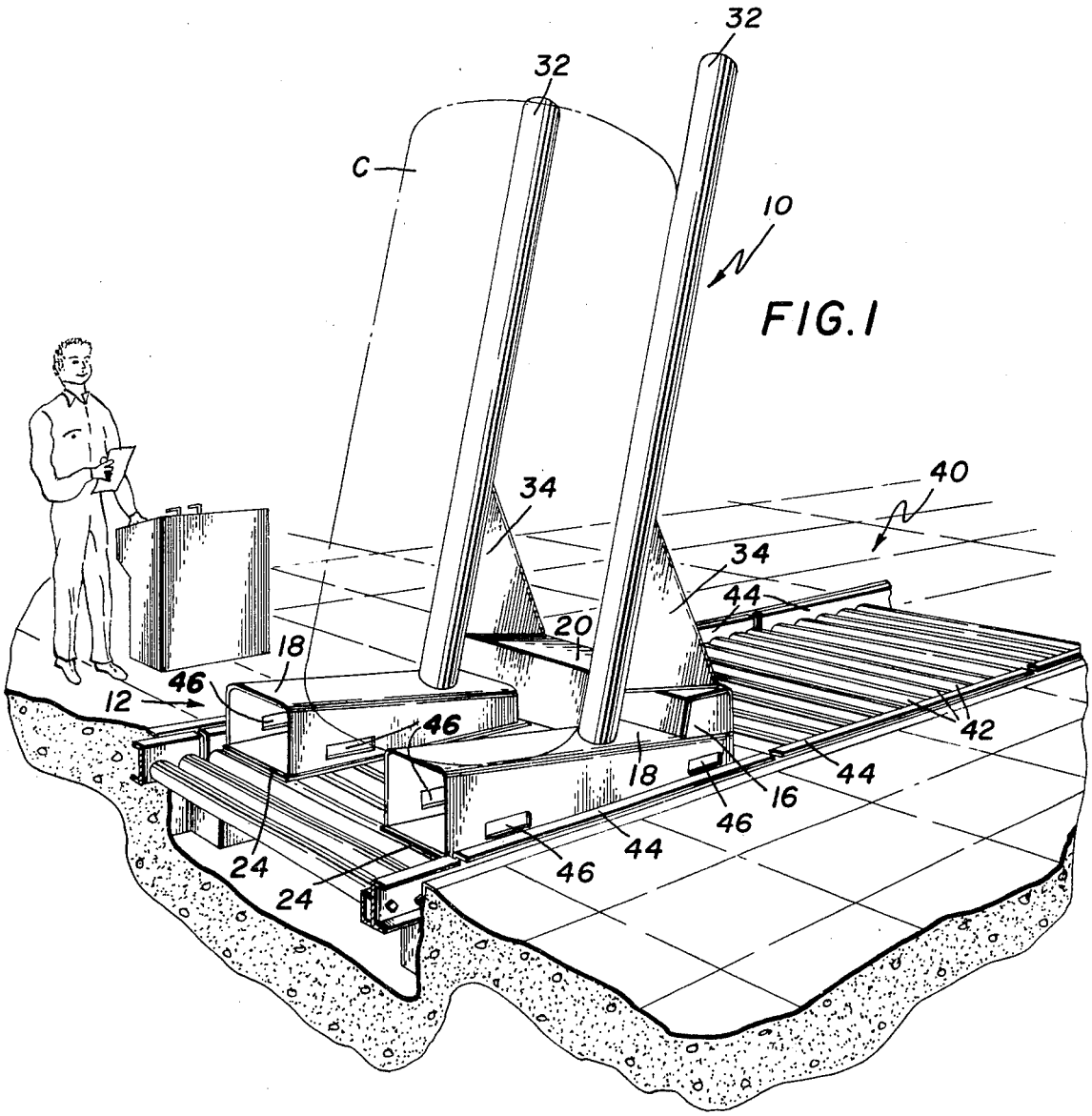
FIG. 1 is a view in perspective showing a pallet in accordance with the present invention at rest on a roller table module at the coil handling area of a rolling mill.
Figure 3:
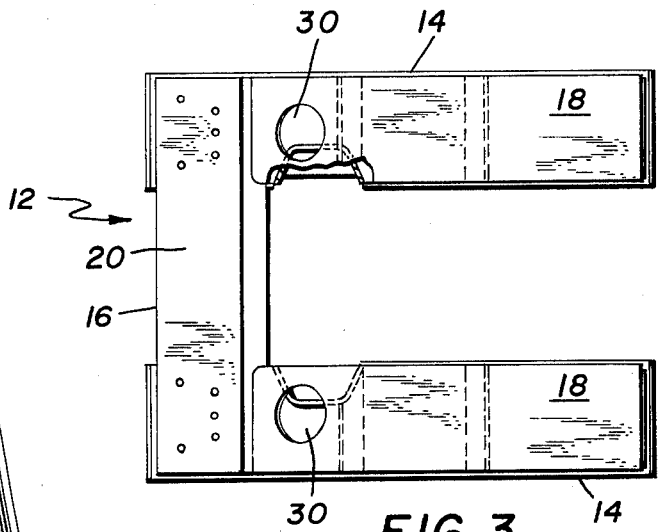

Referring now to the drawings, there is shown at 10 a coil handling pallet in accordance with the present invention. The pallet has a generally U-shaped base section 12 which is made up of a pair of laterally spaced leg members 14 joined at their rearward ends by a laterally extending bridging member 16.

The legs have upper surfaces 18 which are inclined downwardly from front to rear at an angle $\alpha$ with respect to the horizontal of approximately 10°. The upper surface 20 of the bridging member 16 is preferably inclined at the same angle. The legs 14 each have bottom plates 22 extending from front to rear. The front and rear edges of the bottom plates 22 are upturned as at 24.

The upper surfaces 18 of the legs 14 are provided with apertures 30 designed to receive the lower ends of support members or posts 32. Each support post has a rearwardly extending brace 34, the bottom of which is designed to lie flat against the upper surface 20 of the bridging member 16.

Figure 2:
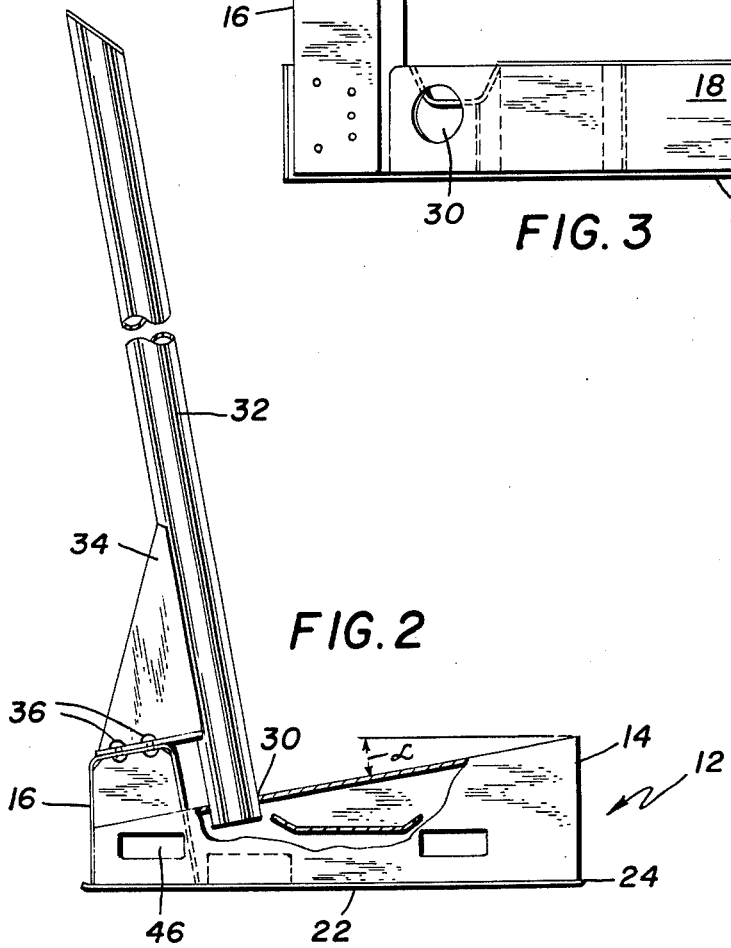
FIG. 2 is a side elevational view with portions broken away of the pallet shown in FIG. 1; and, FIG. 3 is a plan view of the base section with the support posts removed therefrom.

It will be understood that the support posts 32 are readily removable from the base section 12 to facilitate transportation and storage of the pallet components. When a particular pallet is to be placed in service, assembly is a simple matter requiring only insertion of the bottom ends of the support posts 32 into the holes 30. When thus assembled, the support posts protrude upwardly from the leg members 14 at an angle of approximately 90° with the upper surfaces 18 of the legs. The brackets 34 are removably attached to the bridging member 16 by any convenient means such as for example the bolts indicated typically at 36 in FIG. 2.

As can be seen in FIG. 1, the pallet 10 is adapted to receive and support a coil C in an upstanding slightly inclined position. Any suitable mechanism may be employed to load the coil onto the pallet. Once on the pallet, the bottom of the coil will be supported on the inclined upper surfaces 18 of the leg members 14 and the coil will be inclined slightly against the support posts 32. In this condition, the coil may be transported throughout the coil handling area. One means of achieving this is generally indicated at 40 as comprising a longitudinally extending roller conveyor avenue made up of aligned separately powered interchangeable roller table modules, each of which has driven table rollers 42 extending laterally between side members 44. This particular roller table arrangement is the subject of a separate application assigned to the same assignee as that of the present invention.

Preferably, the width of base section 12 is only slightly less than the distance between the side members 44 of the roller conveyor avenue 40, with the result that the side members 44 act as guides for the pallets being conveyed along the length thereof. The upturned forward and rear edges 24 of the bottom plates 22 facilitate movement of the pallet in either a forward or rearward direction across the table rollers 42.

When a coil is supported as shown in FIG. 1 on the pallet 10, arcuate portions of the coil bottom are supported on the inclined upper surfaces 18 of the leg members 14, with the remaining arcuate portions of the coil bottom lying over the open space between the two leg members. The two support posts 32 which are perpendicular to the inclined upper surfaces 18, are tangent to the outside diameter of the coil, thus completely supporting the coil in a stable, slightly inclined upstanding attitude with the center of gravity of the loaded pallet being located near to the physical center of the base section 12.

The legs 14 of the base section 12 may conveniently be provided with suitably positioned holes and/or sleeves 46 which are properly located for balance and which allow the extrance of forks either from the side or from the open ends of the leg members. The forks (not shown) may be truck-mounted so as to allow fork trucks to pick up and carry pallets either loaded or unloaded wherever suitable road surfaces exist. These holes also allow the pallets to be carried by overhead cranes when provided with suitable fork-shaped adapter hooks.

The near-vertical attitude in which coils are supported and carried by the pallets imparts a considerable measure of vertical compaction to the coil which is developed by its own weight. This desirable feature is in contrast to the prevalent horse-collaring and fanning-out of a coil which is transported on a conventional hook carrier system which carries the coil on the horizontal arm of a hook extending through the eye of the coil.

It is my intention to cover all changes and modifications of the embodiment herein chosen for purposes of disclosure which do not depart from the spirit and scope of the invention.

I claim:

1. In a rolling mill, a pallet for use in supporting a cylindrical product coil during the transfer thereof from one location to another, comprising: a generally U-shaped base section having laterally spaced leg members joined at their rearward ends by a bridging member, the upper surfaces of said leg members being inclined downwardly from front to rear, and a pair of support members extending upwardly from the rearward portions of said leg members, said support members being perpendicular to said upper surfaces, whereupon a coil supported on said pallet will have arcuate portions of its lowermost end resting on said inclined upper surfaces,. with the inclination of said surfaces causing the coil to assume an inclined position resting against said support members.

2. The pallet as claimed in claim 1 wherein said support members are detachably mounted to said base section.

3. The pallet as claimed in claim 2 wherein said leg members are suitably apertured to receive the lower ends of said support members in axial insertion therein, the extent to which said lower ends may be inserted into said leg members being limited by bracket members on said support members, which bracket members engage the upper surface of said bridging member.

4. The pallet as claimed in claim 1 wherein the angle of inclination of the upper surfaces of said leg members is approximately 10°.

5. The pallet as claimed in claim 1 wherein said leg members have lower surfaces with upturned front and rear edges.

6. A pallet for use in supporting a cylindrical product coil, comprising: a generally U-shaped base section having laterally spaced leg members joined at their rearward ends by a transverse bridging member, the upper surfaces of said leg members being arranged to contact the coil bottom and being inclined downwardly from front to rear, with the upper surface of said bridging member being parallel to the upper surfaces of said leg members, a pair of support members extending upwardly from the rearward portions of said leg members, said support members being perpendicular to the upper surfaces of said leg members and said bridging member, said support members having brackets engaging the upper surface of said bridging member, whereupon a coil supported on said pallet will have arcuate portions of its lowermost end resting on said inclined upper surfaces, with the inclination of said surfaces causing the coil to assume an inclined position resting against said support members.

7. The pallet as claimed in claim 6 wherein said brackets are detachably connected to said bridging member.

8. A pallet for supporting a cylindrical product coil during the transfer thereof from one location to another, comprising: a base section having leg members arranged laterally to define a space therebetween, the upper surfaces of said leg members being inclined, a pair of support members extending upwardly from said base section, said support members having contact surfaces perpendicular to said upper surfaces and being arranged such that a coil supported on said pallet will have arcuate portions of its lowermost end resting on said upper surfaces, with the inclination of said upper surfaces causing the coil to assume an inclined position resting against the contact surfaces of said support members, and bridging means adjacent to said support members for maintaining the lateral arrangement of said leg members.

* * * * *